US011443906B1

(12) United States Patent
Oakeson et al.

(10) Patent No.: US 11,443,906 B1
(45) Date of Patent: Sep. 13, 2022

(54) KEYBOARD WITH INTERLOCKING KEYCAPS

(71) Applicant: ZAGG INC, Midvale, UT (US)

(72) Inventors: Dan Oakeson, West Jordan, UT (US); Manny Carreon, Lehi, UT (US); Kyle Sorensen, Springville, UT (US)

(73) Assignee: ZAGG, INC, Midvale, UT (US)

( * ) Notice: Subject to any disclaimer, the term of this patent is extended or adjusted under 35 U.S.C. 154(b) by 0 days.

(21) Appl. No.: 17/327,959

(22) Filed: May 24, 2021

(51) Int. Cl.

| | |
|---|---|
| ***H01H 13/12*** | (2006.01) |
| ***H01H 13/80*** | (2006.01) |
| ***H01H 13/88*** | (2006.01) |
| ***H01H 13/86*** | (2006.01) |

(52) U.S. Cl.
CPC ..... *H01H 13/80* (2013.01); *H01H 13/86* (2013.01); *H01H 13/88* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS

| | | | | |
|---|---|---|---|---|
| 9,195,314 | B2 | 11/2015 | Sharma et al. | |
| 10,784,062 | B2 | 9/2020 | Wang et al. | |
| 2013/0334021 | A1* | 12/2013 | Lan | H01H 13/86 200/5 A |
| 2019/0129516 | A1* | 5/2019 | Morrison | H01H 13/86 |

FOREIGN PATENT DOCUMENTS

| | | |
|---|---|---|
| JP | 6736683 | 8/2020 |

* cited by examiner

*Primary Examiner* — Ahmed M Saeed
(74) *Attorney, Agent, or Firm* — Thorpe, North & Western, LLP

(57) ABSTRACT

A keyboard case for a tabled computer has a keyboard with a bezel plate having a matrix of apertures therein. A matrix of keycaps corresponds to the matrix of apertures in the bezel plate. The bezel plate has a web between the matrix of apertures comprising narrower lateral web between laterally proximate apertures and wider diagonal web between diagonally proximate apertures. Pockets extend from corners of each aperture into the diagonal web of the bezel plate. Tabs extend from corners of each keycap into corresponding pockets of the bezel plate to interlock the keycaps to the bezel plate.

19 Claims, 5 Drawing Sheets

KEYBOARD WITH INTERLOCKING KEYCAPS

BACKGROUND

Alphanumeric computer keyboards are often used to interface with a computer, and are utilized in writing, communicating, programming, etc. Keycaps can be carried by the keyboard and can be associated with different alphanumeric characters and symbols. Some keycaps are designed to be removed by pulling and can be replaced with a replacement keycap; while other keycaps are designed to remain fixed to the keyboard. The inadvertent removal of even a single keycap can render a keyboard inoperable.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
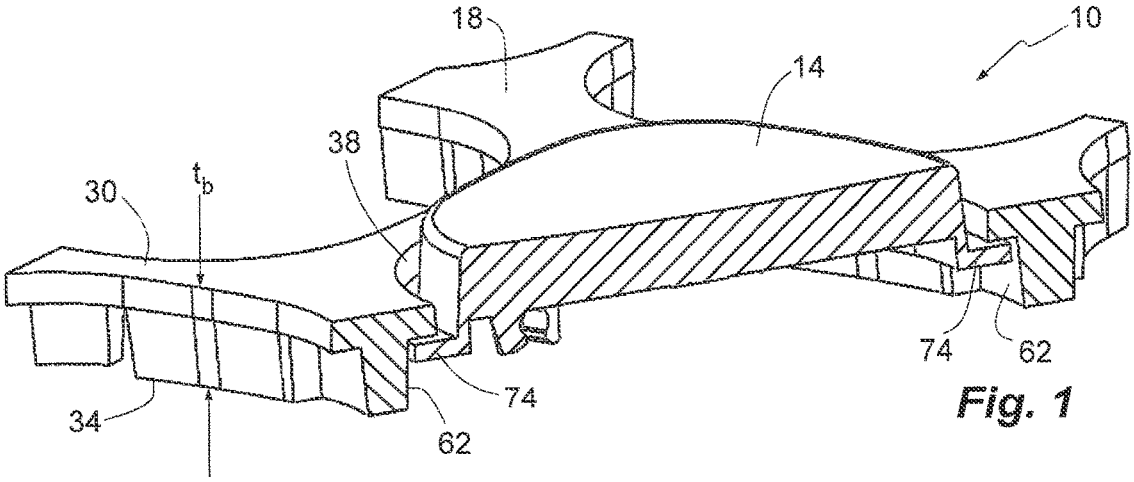
FIG. 1 is a partial cross-sectional perspective view of a keycap in a bezel plate of a keyboard, taken along line 1 in FIG. 15, with various components removed for clarity, in accordance with an embodiment of the invention.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

The invention provides a computer keyboard with keycaps that resist removal and that are interlocked with the bezel of the keyboard to be more rugged. While some keyboards have keycaps that are intended to be removed, such as under 500 gf pull force or 150 gf side force, others keyboard have keycaps that are not intended to be removed. Even keycaps that are not intended to be removed, can be easily pulled from the keyboard. The inadvertent removal of keycaps from either type of keyboard can result in inoperability of the keyboard. Such a situation can arise when a child pulls on the keycap. In addition, such a situation can arise when the keyboard is dropped. The interlock keycaps of the present invention can have tabs that protrude and interlock into pockets in the top cover of bezel plate of the keyboard. Thus, the keycaps of the present invention can resist up to five times the normal pull or side force. In another aspect, the tabs and pockets can be positioned and oriented in the corners of the keycaps so that the keycaps can be located laterally closer together to save space and provide a compact keyboard, which can be useful for tablets. Such a position and orientation of the tabs and pockets can also strengthen the web of the bezel plate between the keycaps. In another aspect, the keyboard can be provided as part of a keyboard case for a tablet.

Figure 14:
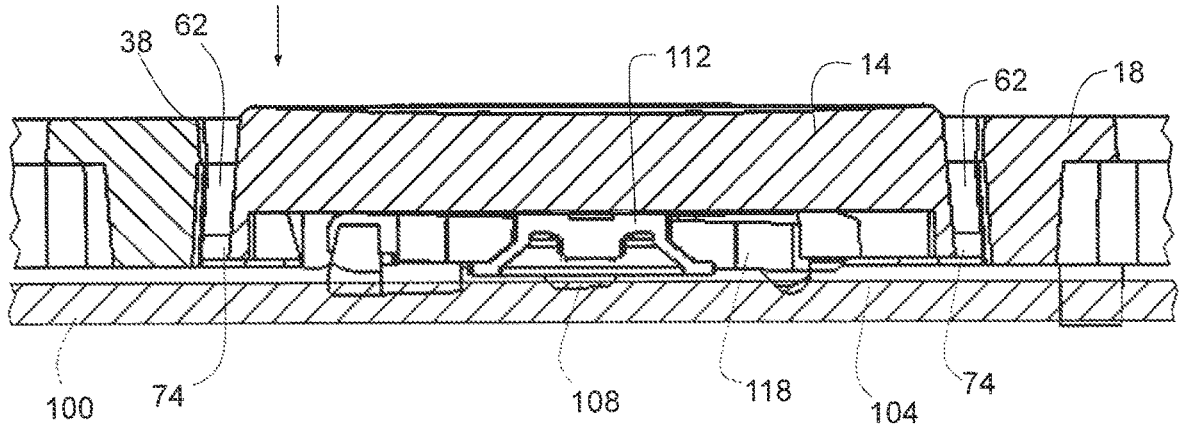
FIG. 14 is a schematic partial cross-sectional side view of the keyboard of FIG. 1, taken along line 13 in FIG. 15, with the keycap shown in a depressed position.

Referring to FIGS. 1-4, a portion of a keyboard 10 with keycaps 14 carried by, retained n, and interlocked with a bezel plate 18 is shown in accordance with one embodiment of the invention. The keyboard 10 can be part of keyboard case 22 carrying a tablet computer 26, as shown in FIG. 14.

The bezel plate 18 can be a top cover of the keyboard 10 and can have a finished outer surface 30 that is exposed. The bezel plate 18 can also have an inner surface 34 opposite and under the finished outer surface 30. The bezel plate 18 can be flat while the finished outer surface 30 and an outermost portion of the inner surface can be flat and parallel with one another. A matrix of apertures 38 can be formed in the bezel plate 18 that corresponds to a matrix of keys 42 (FIG. 15) of the keyboard 10. Each key 42 and keycap 14 can have a separate aperture 38; and thus, each key 42 and keycap 14 can be surrounded and circumscribed by a portion of the bezel plate 18. In one aspect, each aperture 18 in the matrix of apertures can have corners 46 that are rounded with a radius in the plane of the bezel plate 18. The rounded corners 46 can provide a wider diagonal web in the bezel plate 18, as discussed below.

Figure 2:
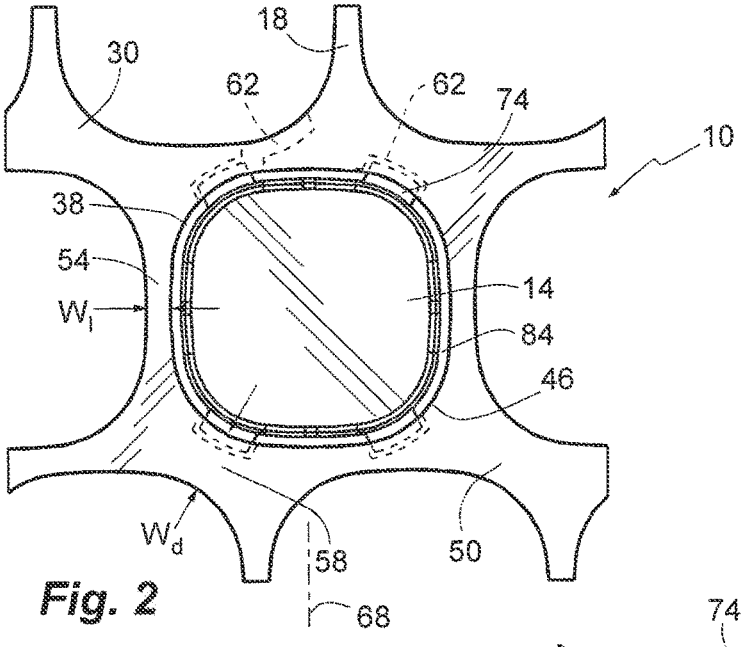
FIG. 2 is a partial top view of the keycap and the bezel plate of FIG. 1, taken from an area of the keyboard designated by line 2 in FIG. 15.
Figure 3:
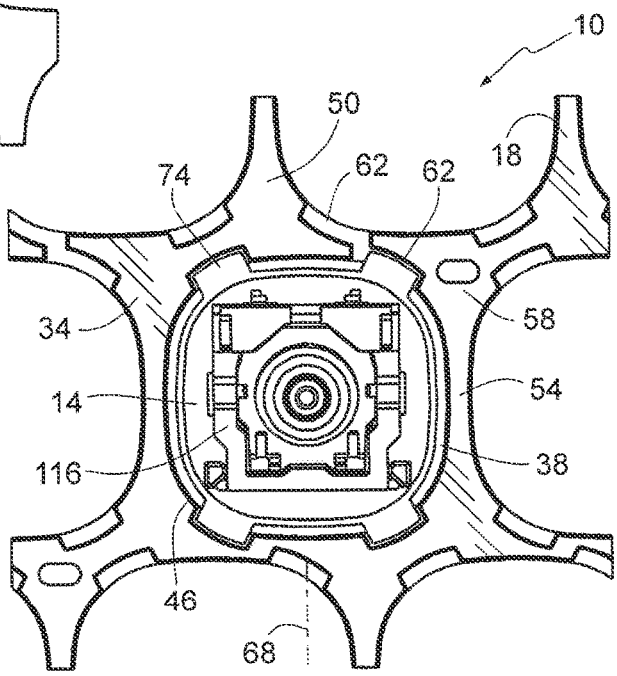
FIG. 3 is a partial bottom view of the keyboard of FIG. 1, taken from the area of the keyboard designated by line 2 in FIG. 15.
Figure 5:
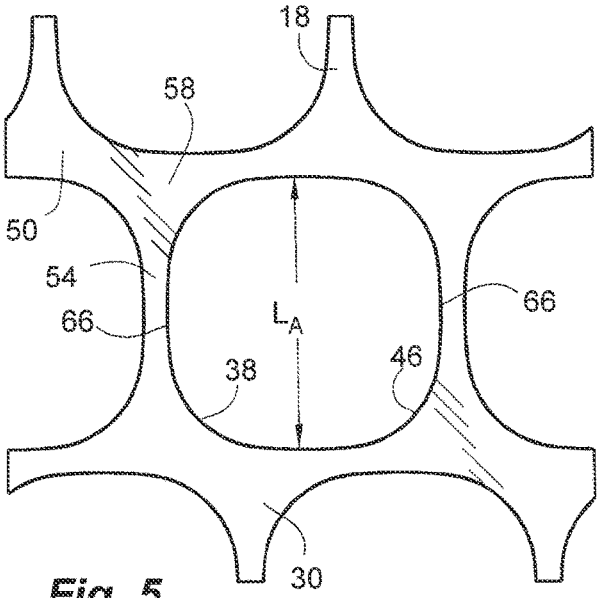
FIG. 5 is a partial top view of the bezel plate of FIG. 1, taken from the area of the keyboard designated by line 2 in FIG. 15.
Figure 4:
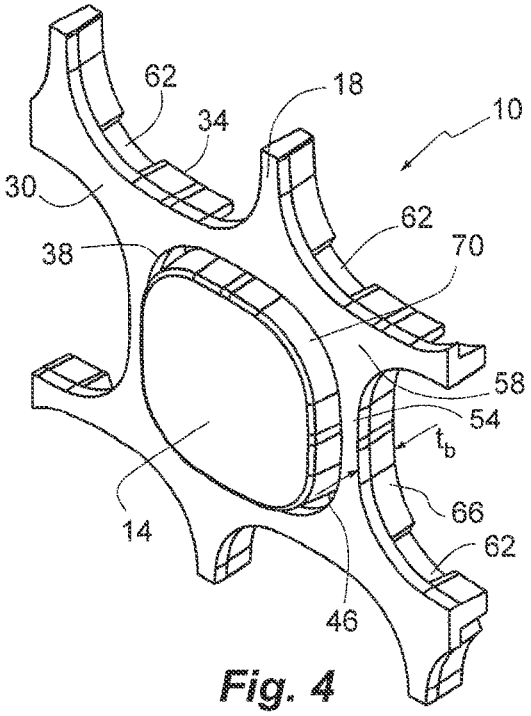
FIG. 4 is a partial perspective view of the keycap in the bezel plate of FIG. 1, taken from the area of the keyboard designated by line 2 in FIG. 15.
Figure 6:
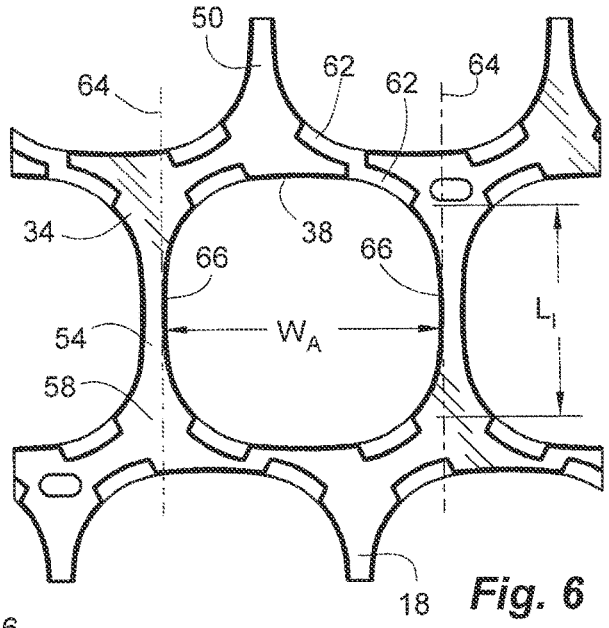
FIG. 6 is a partial bottom view of the bezel plate of FIG. 1, taken from the area of the keyboard designated by line 2 in FIG. 15.
Figure 7:
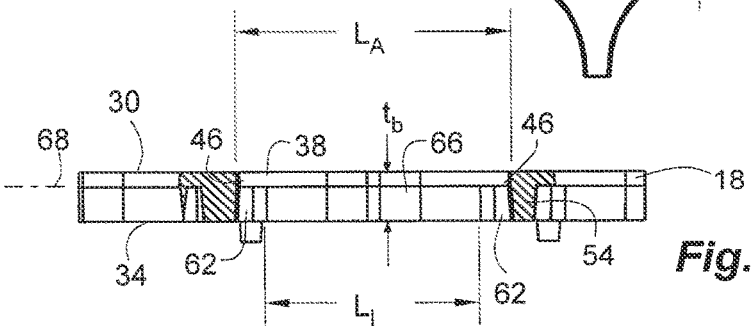
FIG. 7 is a partial side view of the bezel plate of FIG. 1, taken from the area of the keyboard designated by line 2 in FIG. 15.
Figure 9:
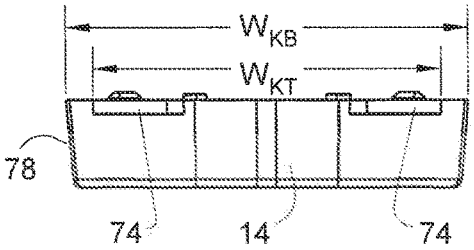
FIG. 9 is rear end view of the keycap of FIG. 1.
Figure 8:
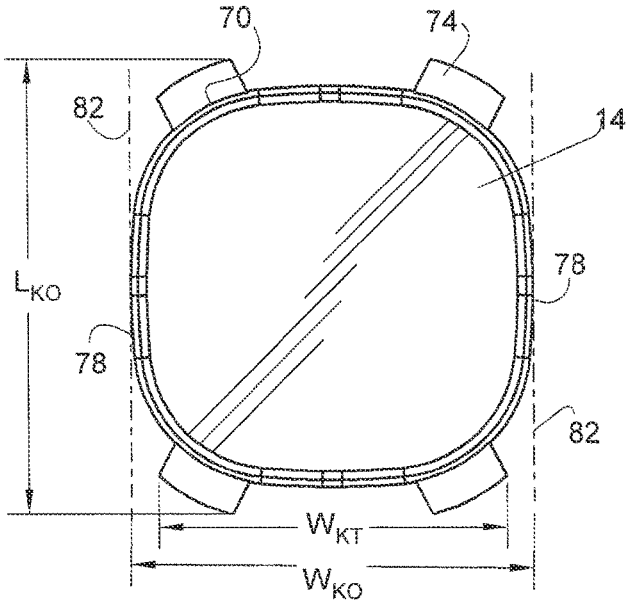
FIG. 8 is a top view of the keycap of FIG. 1.
Figure 11:
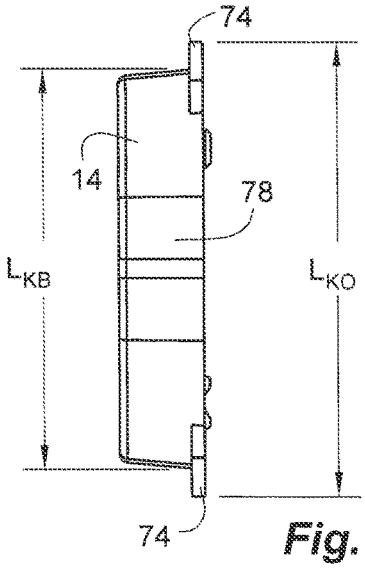
FIG. 11 is a side view of the keycap of FIG. 1.
Figure 10:
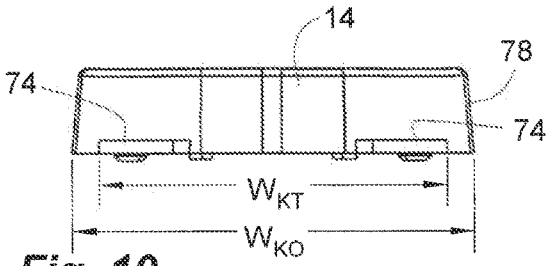
FIG. 10 is a front end view of the keycap of FIG. 1.
Figure 12:
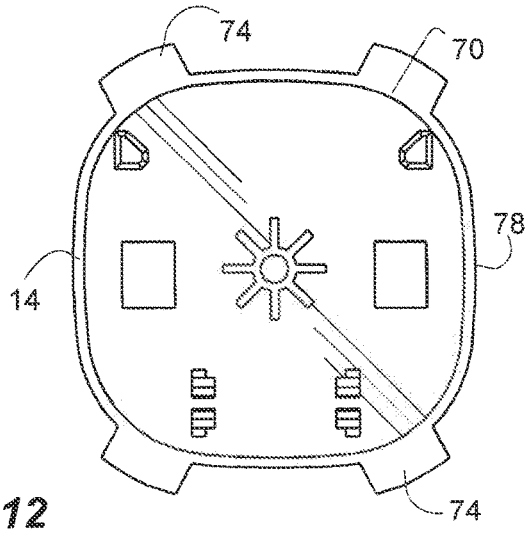
FIG. 12 is a bottom view of the keycap of FIG. 1.

Referring to FIGS. 1-7, the bezel plate 18 can also have a web 50 between the matrix of apertures 38. The web 50 is the solid portion of the bezel plate 18 between the apertures 38. The web 50 can comprise narrower lateral web 54 between laterally proximate apertures 38. The lateral direction is left-and-right with respect to the keyboard 10. Laterally proximate apertures 38 are immediately adjacent one another in a side-by-side relationship, or left-and-right relationship, with the lateral web 54 therebetween. In addition, the web 50 can comprise wider diagonal web 58 between diagonally proximate apertures 38. The diagonally proximate apertures 38 are immediately adjacent one another in an up and left, up and right, down and right, and/or down and left relationship with the diagonal web 58 therebetween. The diagonal web 58 is wider (aperture 38 to aperture 38), and has a wider width $w_d$, than the narrower width $w_l$ of the lateral web 54, as shown in FIG. 2. In one aspect, the rounded corners 46 of the apertures 38 can contribute to the wider width $w_d$.

The keyboard 10 and the bezel plate 18 have pockets 62 extending into the bezel plate 18 from the apertures 38, and from the inner surface 34 proximate the apertures 38. Thus, the pockets 62 can be open to both the apertures 38 and the inner surface 30 under the bezel plate 18. In another aspect, the pockets 62 can be positioned at the corners 46 of each aperture 38 and can extend into the diagonal web 58 of the bezel plate 18. The rounded corners 46 of the apertures 38 and/or the wider width $w_d$ of the diagonal web 58 can provide room for the pockets 62, while the lateral web 54 between the apertures 38, and the keycaps 14, can remain narrower with the narrower width $w_l$. The pockets 62 can have a depth or height extending up from the inner surface 34 towards, but shy of, the finished outer surface 30, to allow tabs to travel with the keycaps 14 as discussed below. The pockets 62 can extend from the corners 46 of the apertures 38 and into the diagonal web 58, but within a lateral perimeter of the aperture 38, indicated by line 64 in FIG. 6.

In one aspect, the lateral web 54 between proximate apertures 38 can be free of pockets. In another aspect, the lateral web 54 between proximate apertures 38 can have a constant thickness $t_b$ between the finished outer surface 30 and the inner surface 34, and between proximate corners 46 of the apertures 38. In another aspect, each aperture 38 can have lateral side walls 66 with constant and solid surfaces from the finished outer surface 30 to the inner surface 30 and along at least 60% of an uninterrupted longitudinal length $L_l$ (FIG. 7) of the aperture 38. The longitudinal direction is front-to-back with respect to the keyboard 10 and indicated by line 68. Thus, the web 50 and the narrower lateral web 54 can be strengthened without pockets 62 therein for increased strength and durability of the bezel plate 18 and the keyboard 10. In addition, the keys 42 and the keycaps 14 can be positioned and spaced to provide a more ergonomic and compact keyboard 10 while maintaining the structure and strength of the web 50, and namely the narrower lateral web 54, of the bezel plate 18. In another aspect, at least some pockets 62 interconnect between proximate diagonal apertures 38 to further save space.

Referring to FIGS. 1-4 and 8-12, the keyboard 10 has a matrix of keycaps 14 corresponding to the matrix of apertures 38 with each keycap 14 positioned in a different aperture 38. Each keycap 38 can have corners 70. In one aspect, the keycaps 14 can match the apertures 38, and can thus have a general square shape with rounded corners. Each keycap 14 has tabs 74 extending from the corners 70 of the keycap 14 and into corresponding pockets 62 of the bezel plate 18. Thus, the tabs 74 and the pockets 62 interlock the keycaps 14 to the bezel plate 18 and the apertures 38 thereof to retain the keycap 14 in the bezel 18 and resist removal.

In one aspect, the tabs 74 can extend from a bottom of the keycap 14. In another aspect, the tabs 74 can extend from rounded corners 70 so that there is a greater distance and more space between diagonally adjacent keycaps 14.

Positioning the pockets 62 in the rounded corners 46 of the aperture 38 and positioning the tabs 74 at the rounded corners 70 of the keycap 14 narrow the lateral web 54 between lateral proximate apertures 38 for a more ergonomic and compact keyboard 10. In another aspect, each keycap 14 can have four tabs 74 with each extending from a different corner 70 so that each corner 70 has a tab 74. In another aspect, each keycap 14 can have a pair of tabs 74 with each tab 74 being located at a different opposite corner 70 diagonally opposite the other tab 74. Thus, the keycap 14 has a diagonal size or diameter between diagonally opposite tabs 74 greater than a diagonal size or diameter of the aperture 38 to retain the keycap 14 to the bezel plate 18.

In another aspect, each keycap 14 is free of lateral tabs extending laterally from lateral sides 78 of the keycap 14. In another aspect, the tabs 74 of each keycap 14 extend a distance from a body of the keycap 14 but within a lateral perimeter of the body of the keycap 14, indicated by line 82 in FIG. 8, on both sides of the keycap 14. Thus, the tabs 74 are kept free of the lateral web 14 of the bezel plate 18, allowing a narrower lateral web 54 between lateral proximate apertures 38 for a more ergonomic and compact keyboard 10.

In another aspect, each keycap 14 can have an outermost longitudinal length $L_{KO}$ dimension (FIGS. 8 and 11) greater than a longitudinal height $L_A$ dimension (FIGS. 5 and 7) of a corresponding aperture 38 in the bezel plate 18 in which they keycap 14 is positioned. The outermost longitudinal length $L_{KO}$ dimension can be between corresponding tabs 74 on opposite longitudinal ends of the keycap 14. In addition, each keycap 14 can have an outermost lateral width $W_{KO}$ dimension (FIGS. 8 and 10) less than a lateral width $W_A$ dimension (FIG. 6) of the corresponding aperture 38. In another aspect, the outermost longitudinal height $L_{KO}$ dimension between corresponding tabs 74 of the keycap 14 can be greater than a longitudinal height $L_{KB}$ dimension (FIG. 11) of a body of the keycap 14. In another aspect, each keycap 14 can have an outermost lateral width $W_{KT}$ dimension (FIGS. 8 and 10) between the corresponding tabs 74 on opposite lateral sides of the keycap 14 less than a lateral width $W_{KB}$ dimension (FIG. 9) of the body of the keycap 14. The lateral width $W_{KB}$ dimension of the body of the keycap 14 can be the same as the outermost lateral width $W_{KO}$ dimension of the keycap 14. Thus, the keycap 14 and the tabs 74 are sized and positioned to allow a narrower lateral web 54 between lateral proximate apertures 38 for a more ergonomic and compact keyboard 10.

In one aspect, each keycap 14 can have two to four separate and discrete tabs 74. The tabs 74 can be separated from proximal tabs 74 by a space greater than a width of the tab 74. Thus, a substantially annular gap 84 (FIG. 2) can be formed between an outer perimeter of the keycap 14 and the bezel plate 18 that is interrupted by the tabs 74. The circumference of the annular gap can be greater than the combined width of the tabs 74. The gap and separation between the tabs 74 allows debris to fall through the bezel plate 18 and apertures 38 and past the tabs 74 to resist the debris from getting trapped between the tabs 74 and the inner surface of the bezel plate 18 and interfering with travel of the keycaps 14.

In one aspect, the keycaps 14 and the bezel plate 18 can be formed of plastic, and can be formed by injection molding.

Figure 13:
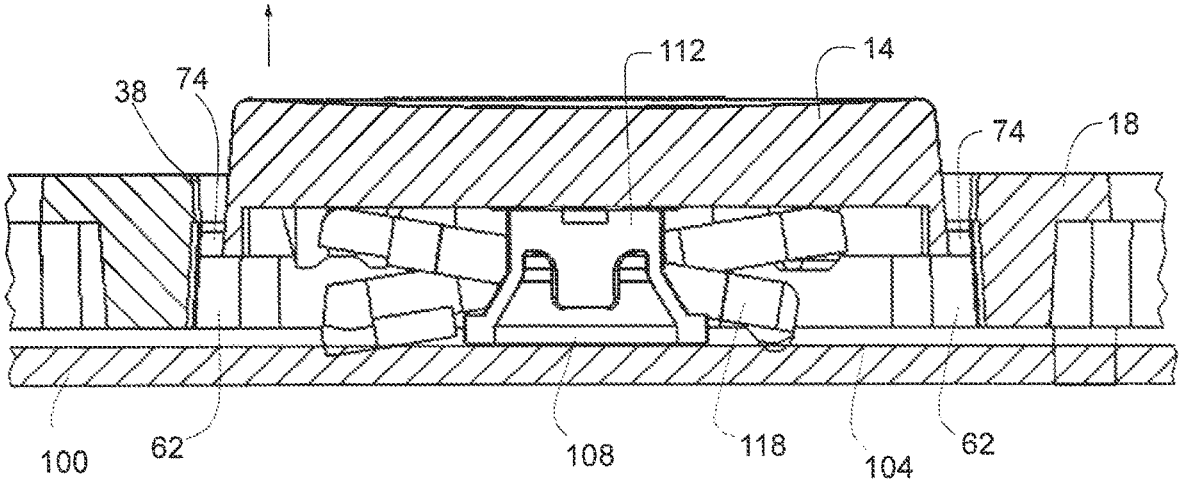
FIG. 13 is a schematic partial cross-sectional side view of the keyboard of FIG. 1, taken along line 13 in FIG. 15, with the keycap shown in a raised position, in accordance with another embodiment of the invention.

Referring to FIGS. 13 and 14, in one aspect, the keyboard 10 can comprise scissor-type alignment mechanisms for the keycaps 14 and flexible b domes to engage a membrane circuit to register key strokes. In one aspect, a backing plate 100 can be positioned behind and below the bezel plate 18. The backing plate 100 can be rigid and flat to carry and support the keycaps 14.

In another aspect, a membrane circuit layer 104 can be carried by the backing plate 100. The membrane circuit layer 104 can have electrical traces and a matrix of electrical contacts 108 corresponding to the matrix of apertures 38 and the matrix of keycaps 14. In another aspect, a matrix of flexible domes 112 can be carried by the membrane circuit layer 104. The matrix of flexible domes 112 can correspond to the matrix of apertures 38 and the matrix of keycaps 14. Each dome 112 can have an internal plunger extending downward from a top of the dome. In addition, each dome 112 can have an expanded configuration away from the electrical contact 108, as shown in FIG. 13, and a compressed configuration engaging the electrical contact 108, as shown in FIG. 14. The domes 112 can extend from the membrane circuit layer 104 and the backing plate 100 to the keycap 14. Thus, depressing the keycap 14 during a keystroke presses the dome 112 and the plunger thereof into contact with the electrical contact 108. The domes 112 can bias the keycaps upwardly.

In another aspect, a matrix of scissor-type connecting mechanisms 116 can be carried by the backing plate 100 and can correspond to the matrix of apertures 38 and the matrix of keycaps 14. Each keycap 14 can be carried by a scissor-type connecting mechanisms 116 and a dome 112. Each scissor-type connecting mechanism 116 can have an extended position, as shown in FIG. 13, and a retracted position, as shown in FIG. 14. The scissor-type connecting mechanisms 116 can help maintain alignment of the keycap 14 during keystroke travel.

The matrix of keycaps 14 can be carried by the matrix of scissor-type connecting mechanisms 116 and can correspond to the matrix of apertures 38. Thus, each keycap 14 can be positioned in an aperture 38 and connected to a scissor-type connecting mechanism 116. Each keycap 14 can have a stroke from: 1) a raised position, to 2) a depressed position. The raised position of the keycap 14 corresponds to the extended position of the scissor-type connecting mechanism 116 and the expanded configuration of the dome 112. The depressed position of the keycap 14 corresponds to the retracted position of the scissor-type connecting mechanism 116 and the compressed configuration of the dome 112. Each keycap 14 is movable with respect to the bezel plate 18 and travels between the raised and depressed positions. The tabs 74 of the keycap 14 remain in corresponding pockets 62 of the bezel plate 18 during keystroke travel of the keycap 14.

Figure 15:
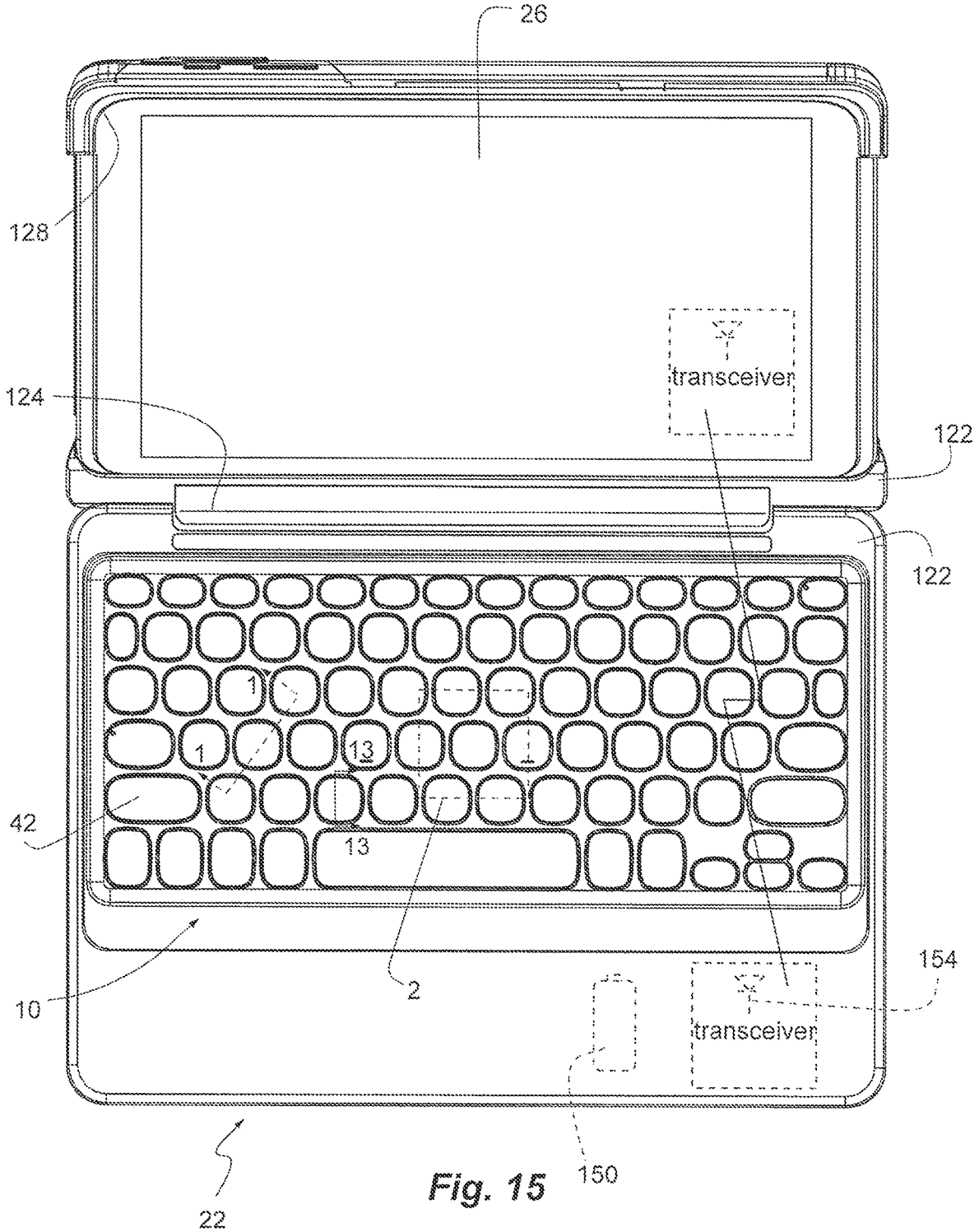
FIG. 15 is a top view of a keyboard case with the keyboard of FIG. 1, and shown with a tablet computer and shown in an open configuration, in accordance with another embodiment of the invention.

Referring to FIG. 15, as discussed above, the keyboard 10 can be part of the keyboard case 22 that holds and connects to the tablet computer 26. Thus, the tablet computer 26 can be placed in and protected by the keyboard case 22, while the keyboard 10 can wirelessly pair to and operably communicating with the tablet computer 26. The keyboard case 22 can have a pair of leafs 120 pivotally coupled together by a hinge 124. One leaf can comprise a cavity 128 to releasably receive and hold the tablet computer 26. The other leaf can comprise the keyboard 10. As described above, the keyboard 10 can have a matrix of keys 42 formed and defined by the keycaps 14 in the apertures 38 of the bezel plate 18. The keyboard 10 can further comprise a battery 150 and an antenna 154 carried by one of leaves. The keyboard 10 can have circuitry and control electronics powered by the battery 150 to register keystrokes and communicate the keystrokes wirelessly via the antenna 154.

The description above of a matrix, such as the matrix of keys 42, matrix of keycaps 14, and matrix of apertures 38, refers to a plurality, such as a plurality of keys 42, a plurality of keycaps 14 or a plurality of apertures 38, arrayed in two dimensions, such as side-to-side and forward-and-rearward. The matrix or plurality may include most, a majority or a super majority without including all. The keys 42, the keycaps 14 and the apertures 38 can be arranged linearly in rows, while being offset with respect to a proximal row to create a diagonal relationship. The description above of each refers to each element of the matrix, such as each keycap 14 in the matrix or plurality of keycaps, and not necessarily each keycap 14 of the keyboard 10. Thus, most, a majority or even a supermajority of the keycaps may be as described above, while a few keycaps may be an exception. For example, as shown in FIG. 15, the arrow keys or cursor movement keys may share a single aperture in the bezel plate. As another example, some keycaps may be sized or shaped differently, and thus have different locations or numbers of tabs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the items) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front." "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

The terms "interference fit" and "friction fit" and "press-fit" are terms of art used interchangeably herein to refer to deliberately causing, increasing and/or using friction to deliberately resist movement. An interference fit or friction fit is different than and great than the existence of friction. While friction may exist between any two surfaces, is often desirable to do all one can to reduce this friction. An interference fit or friction fit can be distinguished from naturally occurring friction by being actually deliberately caused and increased. An interference fit can be created by dimensioning engaging parts so that their surfaces tightly bear against one another. A friction fit can be created by surface roughness that is rougher.

The terms "tablet computer" and "tablet" are used interchangeably herein to refer to a computer or multi-media device that is one-piece with a screen and that is portable and handheld. Examples of tablets include the Apple iPad™, the Samsung™ Galaxy™ Tab™, etc. The screen can be a touch screen that can receive input by touch, such as finger swipes, and/or can have a virtual keyboard displayed on the screen. The tablet can be wide (or broad) and thin. For example, the screen can have a diagonal length greater than 7 inches, and a thickness less than a ¼-½ inch. The tablet can have a battery and memory and a processor with software running thereon. The battery can be charged and can power the tablet for extended periods. Thus, the tabled can be portable and transportable during operation. The tablet can have one or more transceivers or antennas for wireless connectivity, such as WiFi and Bluetooth connectivity. Thus, the tablet can provide internet browsing, game playing, movie and picture display, e-book display, etc. In addition, the tablet can include a digital camera. Furthermore, the terms tablet computer and tablet are used broadly herein to refer to cellular or cell phones (or smart phones) and phablets, which also provide similar computing capabilities, battery power, memory, processor, software, WiFi and Bluetooth connectivity, touch screen display, digital camera, etc. Such phones or phablets can have a screen with a diagonal length less than 7 inches and a thickness less than 10 mm. Examples of cell phones and phablets include the Apple iPhone, the Samsung Galaxy S phone series, the Samsung Note phablet, etc.

The term "keyboard" refers to an array or matrix of alphanumeric (both alphabetical and/or numeric) or character keys, modifier keys for altering the functions of other keys, navigation keys for moving the text cursor on a display, function keys and/or system command keys. The keyboard can have a keyboard layout with keys arranged in an acceptable format or standard, such as the QWERTY layout. The keyboard layout can include three rows of characters or letters, a row of numbers above the characters, and one or two rows of other keys, such as a space bar, modifier keys, function keys, navigations keys, etc., for a total of five or six rows. Most of the keys can be square or rectilinear buttons of the same size and shape. In addition, the keys can be buttons capable of registering contact, pressure or force from a user's fingers. The keys or buttons can use any appropriate switch technology, including for example, membrane, dome-switch, scissor-switch, capacitive, mechanical-switch, buckle spring, Hall effect, laser, optical, etc. The keys, buttons and/or switches can provide a feedback response and can have a travel distance. Furthermore, the keyboard can be part of, or can itself form, a leaf or a panel that can be removably coupled to a tablet, and that can form a cover for a tablet. In use, the keyboard can be physically, but not electrically coupled to the tablet; or can be remote from the tablet. When not in use, the keyboard can be physically, but not electrically, coupled to the tablet. In addition, the keyboard or cover can include battery power, a wireless transmitter, receiver, or transceiver, a memory, a processor, and software. In one aspect, the keyboard can include one or more transceivers or antennas for WiFi and Bluetooth connectivity. In another aspect, the keyboard can include a physical and electrical connection. Thus, they keyboard can have both a physical and a communication connection with the tablet.

The terms "antenna", "transceiver", "transmitter" and "receiver" are used interchangeable herein unless otherwise designated, and refer to an antenna to transmit and/or receive electromagnetic signals, such as between the keyboard and the tablet.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A keyboard case configured to hold and connect to a tablet computer, the keyboard case comprising:

a pair of leafs pivotally coupled together by a hinge with one leaf comprising a cavity configured to releasably receive and hold the tablet computer, and with the other leaf comprising a keyboard capable of operably communicating with the tablet computer and having a matrix of keys;

the keyboard comprising:

a bezel plate having a finished outer surface, an inner surface and a matrix of apertures therein corresponding to the matrix of keys;

a backing plate behind the bezel plate;

a membrane circuit layer carried by the backing plate and having electrical traces and a matrix of electrical contacts corresponding to matrix of apertures;

a matrix of flexible domes carried by the membrane circuit layer and corresponding to the matrix of apertures, each dome having an expanded configuration away from an electrical contact and a compressed configuration engaging the electrical contact;

a matrix of scissor-type connecting mechanisms carried by the backing plate and corresponding to the matrix of apertures, each scissor-type connecting mechanism having an extended position and a retracted position;

a matrix of keycaps carried by the matrix of scissor-type connecting mechanisms and corresponding to the matrix of apertures such that each keycap is positioned in an aperture and connected to a scissor-type connecting mechanism, each keycap having a stroke from: i) a raised position corresponding to the extended position of the scissor-type connecting mechanism and the expanded configuration of the dome, and ii) a depressed position corresponding to the retracted position of the scissor-type connecting mechanism and the compressed configuration of the dome;

each aperture in the matrix of apertures having a rounded corner;

the bezel plate having a web between the matrix of apertures comprising narrower lateral web between laterally proximate apertures and wider diagonal web between diagonally proximate apertures;

pockets extending diagonally with respect to a longitudinal direction of the keyboard from rounded corners of each aperture into the inner surface of the diagonal web of the bezel plate;

each keycap having rounded corners;

tabs extending diagonally with respect to the longitudinal direction of the keyboard from rounded corners of each keycap into corresponding pockets of the bezel plate.

2. The keyboard case of claim 1, wherein each lateral web of the bezel plate between proximate apertures has a constant thickness between the finished outer surface and the inner surface between proximate rounded corners of the apertures.

3. The keyboard case of claim 1, wherein each lateral web of the bezel between proximate apertures is free of pockets.

4. The keyboard case of claim 1, wherein at least some pockets interconnect between proximate diagonal apertures.

5. The keyboard case of claim 1, wherein each keycap is free of lateral tabs extending laterally from lateral sides of the keycap.

6. The keyboard case of claim 1, wherein each keycap has an outermost longitudinal length dimension greater than a longitudinal length dimension of a corresponding aperture in the bezel plate in which the keycap is positioned, and an outermost lateral width dimension less than a lateral width dimension of the corresponding aperture.

7. The keyboard case of claim 1, wherein each keycap has an outermost longitudinal length dimension between corresponding tabs of the keycap greater than a longitudinal length dimension of a body of the keycap, and an outermost lateral width dimension between the corresponding tabs less than a lateral width dimension of the body of the keycap.

8. The keyboard case of claim 1, wherein the tabs of each keycap extend diagonally a distance within a lateral perimeter of a body of the keycap.

9. The keyboard case of claim 1, wherein each keycap has four rounded corners and four tabs extending therefrom with each rounded corner having a tab.

10. The keyboard case of claim 1, wherein each keycap has a pair of tabs with each tab being located at an opposite corner diagonally opposite the other tab.

11. The keyboard case of claim 1, wherein the keyboard further comprises:

a battery carried by the other leaf; and an antenna carried by the other leaf.

12. The keyboard case of claim 1, wherein each pocket has sides oriented diagonally with respect to the longitudinal direction of the keyboard; and wherein each tab has sides oriented diagonally with respect to the longitudinal direction of the keyboard.

13. The keyboard case of claim 1, wherein each pocket extends entirely from within a respective rounded corner of a respective aperture; and wherein each tab extends entirely from within a respective rounded corner of a respective keycap.

14. A keyboard case configured to hold and connect to a tablet computer, the keyboard case comprising:

a pair of leafs pivotally coupled together by a hinge with one leaf comprising a cavity configured to releasably receive and hold the tablet computer, and with the other leaf comprising a keyboard capable of operably communicating with the tablet computer;

the keyboard comprising:

a bezel plate having a finished outer surface, an inner surface and a matrix of apertures therein;

a matrix of keycaps corresponding to the matrix of apertures in the bezel plate such that each keycap is positioned in an aperture, each keycap being movable with respect to the bezel plate and traveling between a raised position and a depressed position;

the bezel plate having a web between the matrix of apertures comprising narrower lateral web between laterally proximate apertures and wider diagonal web between diagonally proximate apertures;

pockets extending diagonally with respect to a longitudinal direction of the keyboard from corners of each aperture into the inner surface of the diagonal web of the bezel plate; and tabs extending diagonally with respect to the longitudinal direction of the keyboard from corners of each keycap into corresponding pockets of the bezel plate.

15. The keyboard case of claim 14, wherein each lateral web of the bezel plate between proximate apertures has a constant thickness between the finished outer surface and the inner surface between proximate rounded corners of the apertures.

16. The keyboard case of claim 14, wherein each lateral web of the bezel between proximate apertures is free of pockets.

17. The keyboard case of claim 14, wherein at least some pockets interconnect between proximate diagonal apertures.

18. The keyboard case of claim 14, wherein each keycap is free of lateral tabs extending laterally from lateral sides of the keycap.

19. A keyboard case configured to hold and connect to a tablet computer, the keyboard case comprising:

a pair of leafs pivotally coupled together by a hinge with one leaf comprising a cavity configured to releasably receive and hold the tablet computer, and with the other leaf comprising a keyboard capable of operably communicating with the tablet computer;

the keyboard comprising:

a bezel plate having a finished outer surface, an inner surface and a matrix of apertures therein;

a matrix of keycaps corresponding to the matrix of apertures in the bezel plate such that each keycap is positioned in an aperture, each keycap being movable with respect to the bezel plate and traveling between a raised position and a depressed position;

the bezel plate having a web between the matrix of apertures comprising narrower lateral web between laterally proximate apertures and wider diagonal web between diagonally proximate apertures;

each lateral web of the bezel plate between proximate apertures has a constant thickness between the finished outer surface and the inner surface between proximate rounded corners of the apertures;

pockets extending diagonally with respect to a longitudinal direction of the keyboard from corners of each aperture into the inner surface of the diagonal web of the bezel plate;

each lateral web of the bezel between proximate apertures being free of pockets;

tabs extending diagonally with respect to the longitudinal direction of the keyboard from corners of each keycap into corresponding pockets of the bezel plate;

the tabs of each keycap extending a distance within a lateral perimeter of a body of the keycap; and each keycap being free of lateral tabs extending laterally from lateral sides of the keycap.

* * * * *